United States Patent [19]

Mikuriya

[11] Patent Number: 4,571,846

[45] Date of Patent: Feb. 25, 1986

[54] SCALE BALANCING DEVICE IN UNIVERSAL PARALLEL RULER DEVICE

[76] Inventor: Hideo Mikuriya, c/o Mutoh Industry, Ltd., 3-1-3, Ikejiri, Setagaya-ku, Tokyo, Japan

[21] Appl. No.: 689,899

[22] Filed: Jan. 9, 1985

[51] Int. Cl.[4] ..... B43L 13/02

[52] U.S. Cl. ..... 33/438; 33/440

[58] Field of Search ..... 33/438, 430, 439, 440, 33/448

[56] References Cited

U.S. PATENT DOCUMENTS 4,070,758 1/1978 Watanabe ..... 33/438

*Primary Examiner*—Willis Little

*Attorney, Agent, or Firm*—Wenderoth, Lind & Ponack

[57] ABSTRACT

A scale balancing device for balancing the weight of the scales of a universal parallel ruler, the device having a head structure having a rotating scale support rotatably mounted thereon on which the scales are carried, a rotating member rotatably mounted on the head structure offset from the rotating support, the rotating member and the scale support being rotatably interlocked, an eccentric member on the rotating member and having a portion projecting axially of the rotating member beyond the axial end surface of the rotating member, and a spring member having one end connected to the projecting portion and the other end connected to the head structure and tensioned for providing a torque on the rotating member in a direction which substantially cancels out the torque on the rotating member from the weight of the scales, whereby during rotation of the rotating member through 360 degrees, the one end of the spring member can continuously engage the projecting portion of the eccentric member and the spring member is not hooked by the rotating member.

3 Claims, 7 Drawing Figures

SCALE BALANCING DEVICE IN UNIVERSAL PARALLEL RULER DEVICE

BRIEF SUMMARY OF THE INVENTION:

This invention relates to a scale balancing device in a universal parallel ruler device wherein a scale is caused to be set in a freely rotatable condition relative to a non-rotating member of a head on an inclinable drawing board whereby the scale is not rapidly rotated in a downward direction due to an inclination of the drawing board, thereby to maintain the scale in a stable and static condition.

Scale balancing devices in a universal parallel ruler device are available in various types, but the devices are classified roughly into a balance weight system and an eccentric cam system. The balance weight system is one in which the weight of a balance weight is caused to work in a direction opposite to the rotating direction on a member interlocked with the rotation of a scale in a downward direction to balance the scale by the action of the weight. A balancing device of this type is disclosed in the publications, for example, the Japanese Utility Model Publication No. 47-9478, Japanese Patent Publication No. 57-47040, Japanese Patent Publication No. 57-49399 and Japanese Patent Publication No. 58-4640. On the other hand, the eccentric cam system is one in which a spring is caused to work on an eccentric cam interlocked with the rotation of a scale, and a rotatory torque is generated on the eccentric cam by the elastic force of the spring in a direction opposite to the rotating direction of the scale due to the weight of the scale to balance the scale. A balancing device of the eccentric cam system type is disclosed in Japanese Utility Model Publication No. 52-28605.

The balancing weight system has a drawback, for example, that the weight of the overall apparatus becomes heavy due to the use of the balance weight and also, the manual rotation of the scale against the inertia force of the balance weight becomes heavy. The eccentric cam system has a drawback that, for example, a frictional force is generated on an elastic contact portion of the spring and the eccentric cam whereby the manual rotation of the scale against the frictional force becomes heavy.

A primary object of this invention is to provide a scale balancing device which does not use a balance weight or an eccentric cam, and the scale is maintained in a balanced condition by connecting a spring member to a rotating member that rotates by interlocking with the scale, whereby the scale can be rotated by a light manual operation.

Another object of this invention is to provide such a scale balancing device in which the spring member for providing a balancing force which is connected to an eccentric portion of the rotating member interlocked with a scale mounting plate is not hooked on the rotating member even though the scale mounting plate is rotated more than 360 degrees, and with this arrangement, the scale can rotate over a range of 360 degrees, and moreover, the scale can be balanced over a range of 360 degrees.

DESCRIPTION OF THE PREFERRED EMBODIMENT:

The construction of this invention will be described in detail in the following by referring to the embodiments illustrated in the attached drawings.

Figure 1:
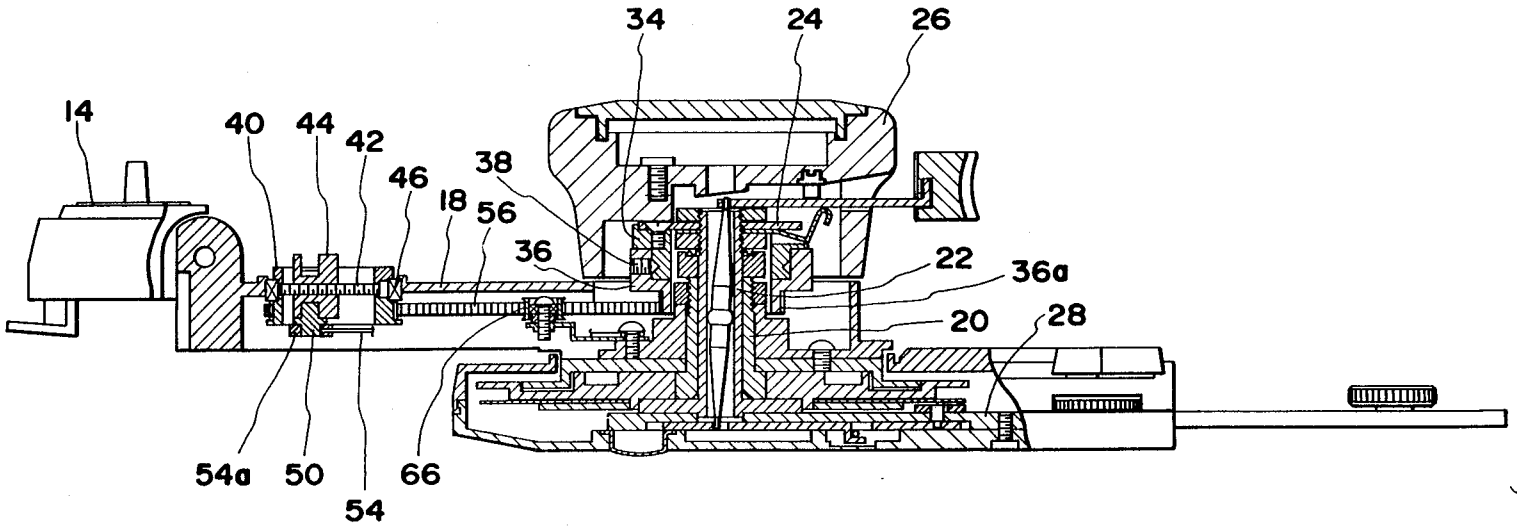
FIG. 1 is a cross section of a head of a scale for a universal parallel ruler device.
Figure 2:
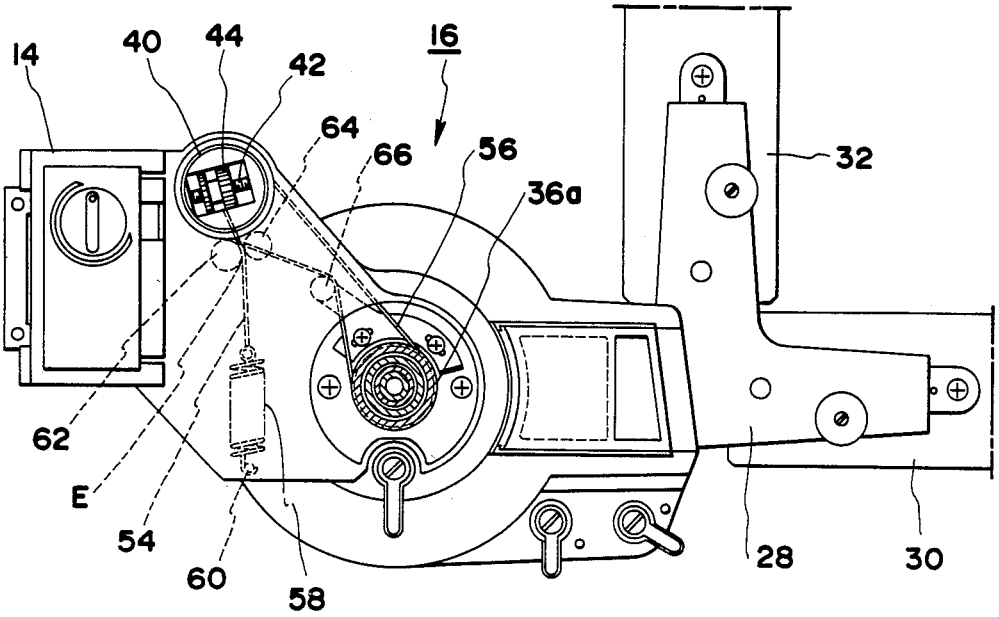
FIG. 2 is a plan view of the head partly in cross section.
Figure 3:
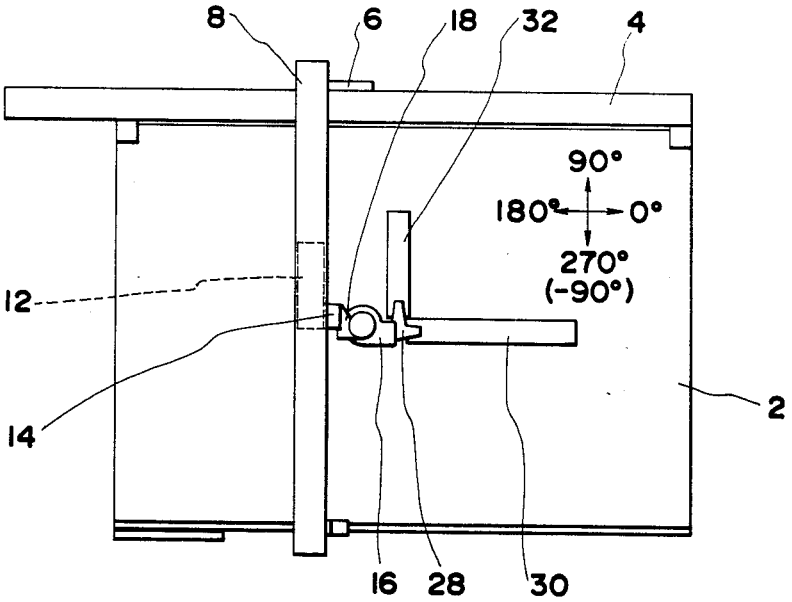
FIG. 3 is an elevation view of a universal parallel ruler device.
Figure 4:
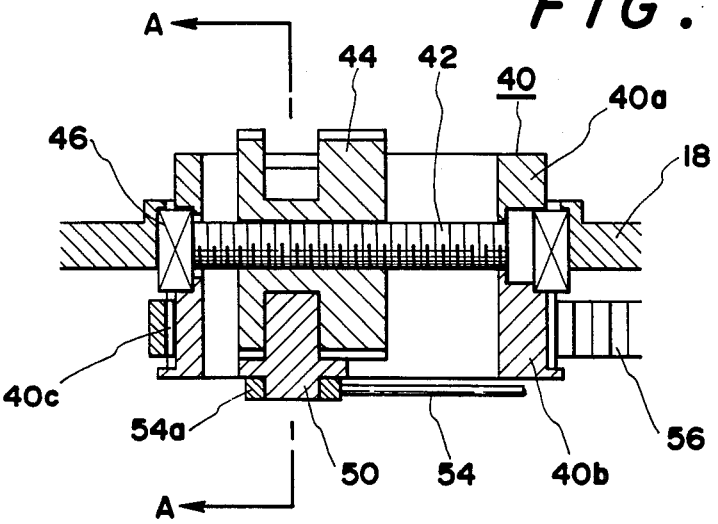
FIG. 4 is a cross section of an essential part thereof.
Figure 5:
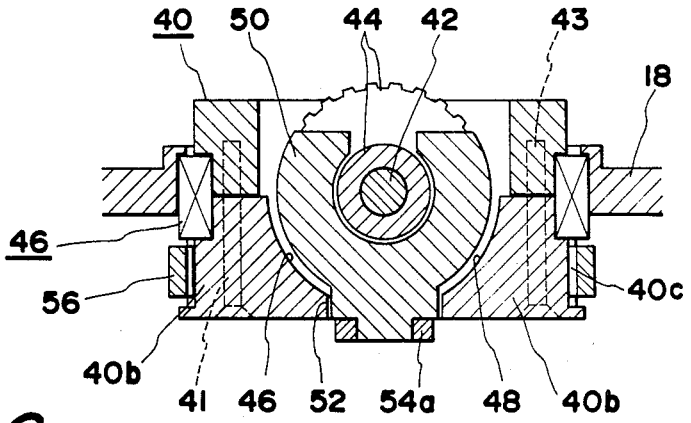
FIG. 5 is a cross section taken on line A—A in FIG. 1.

Reference numeral 2 denotes a drawing board, which is supported on a support frame of an inclinable drawing stand (not shown) so as to be set at any desired angle of inclination between the horizontal and the vertical. Numeral 4 denotes a horizontal rail fixed on an upper edge of the drawing board 2, and a horizontal cursor 6 is shiftably mounted on the horizontal rail. The upper end of a vertical rail 8 is connected to the horizontal cursor 6. The lower end of the vertical rail 8 is mounted on the drawing board 2 so as to be able to travel therealong by means of a tail roller. Numeral 12 denotes a vertical cursor mounted shiftably on the vertical rail 8, and a support base plate 18 of a head 16 is connected to the vertical cursor 12 by means of a known double hinge mechanism 14. A tubular member 20 of pipe type is fixed to a tubular portion of the support base plate 18 by means of a nut. Numeral 22 denotes a tubular spindle, and its outer peripheral surface is fitted rotatably in the inner peripheral surface of the tubular member 20, and also, a mounting plate 24 is fixed to the upper portion of the spindle 22. A handle 26 is fixed to the mounting plate 24. Numeral 28 denotes a scale mounting plate fixed to a flange portion of the spindle 22, and scales 30 and 32 are fixed to the scale mounting plate. Numeral 34 denotes a support tube fixed to the mounting plate 24, and its outer peripheral surface has a rotating member 36 rotatably mounted thereon and constituting a belt pulley having teeth **36*a* thereon for engagement by a timing belt 56. A tapped hole is formed on a side wall of the rotating member 36, and the rotating member 36 is fixed to the support tube 34 by a set screw 38 screwed into the tapped hole. Numeral 40 denotes a second rotating member, which is comprised of an upper cylinder 40*a* and a lower cylinder 40*b*, and the cylinders 40*a* and 40*b* are connected by screws 41 and 43 (refer to FIG. 5). In the middle portion of the rotating member 40, a feed screw 42 is fixedly mounted in a diametral direction of the rotating member 40, and an adjusting ring 44 is threaded onto the screw 42. An inner ring of a ball bearing 46 is fitted and fixed in a concave groove formed the an outer peripheral portion of the rotating member 40, and the outer ring of the ball bearing 46 is fitted and supported on an inner wall surface of a hole bored in the support base plate 18. A pair of curved guide surfaces 47 and 48 are formed on the cylinder 40*b*, and the outer peripheral curved surface of an element 50 fitted rotatably in a concave portion of the ring 44 is opposed to and disposed on the guide surfaces 47 and 48. The guide surfaces 47 and 48 prevent the weight of the element 50 from falling. A long hole 52 is bored in the bottom wall of the cylinder 40*b* along the feed screw 42, and a projection on the element 50 is shiftably disposed in the long hole 52. The projection of the element 50 extends past the end of the rotating member 40. A metal terminal 54***a* connected to one end of a bendable wire rope 54 having pliability is rotatably fitted on the projection of the element 50. On an outer periphery of the rotating member 40, a belt pulley 40*c* formed with teeth for the timing belt is formed, and the timing belt 56 is reeved around the belt pulley 40*c* and the belt pulley 36*a*. Numeral 58 denotes a coil spring, and its one end is engaged with a screw 60 on the support base plate 18, and the other end is connected to the rope 54. Numerals 62 and 64 denote a pair of rope guides rotatably journaled on the support base plate 18, and 66 denotes a tension pulley for belt 56, and which is journaled rotatably on a bracket fixed to the support base plate 18. Assuming that the metal terminal 54*a*, namely, one end of the rope 54 is released from the element 50 and is positioned at a direction control end E of the rope by the rope guides 62 and 64, an initial position of the coil spring 58 is set so that the tension of the rope 54 caused by the coil spring 58 is just zero. The coil spring 58 is a type is employed which has a spring constant corresponding to a torque of rotation produced on the first rotating member 36 by the weight of the scale mounting plate 28, scales 30 and 32 and the like. The belt pulley 36*a* may be fixed to the scale mounting plate 28. The head 16 is so constructed that it can be located and postionally fixed at any optional position on an inclined drawing board 2 by a known head balancing device (not shown).

The operation of this embodiment will be described in the following.

Figure 7:
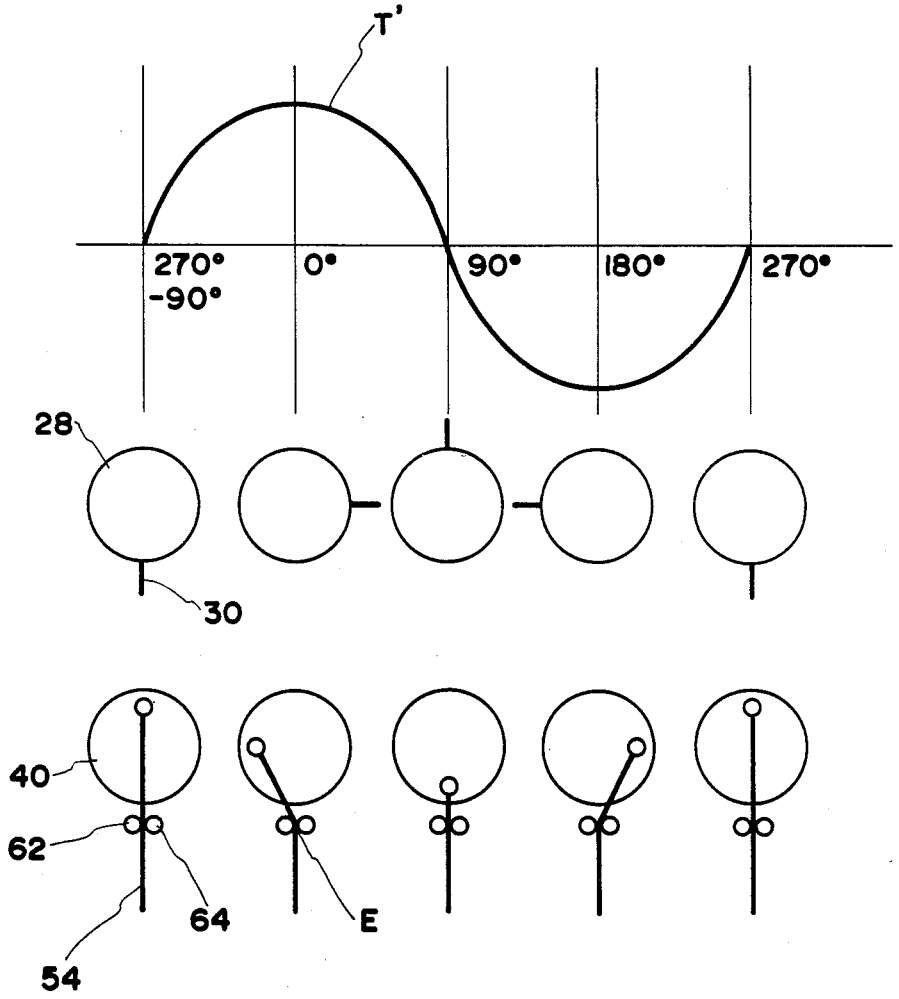
FIG. 7 is an explanatory diagram for the operation of the scale balancing device of the invention.

In the condition where the drawing board 2 is inclined at a predetermined angle, and also the scale mounting plate 28 is freely rotatable on the support base plate 18, a torque T of rotation is generated on the first rotating member 36 which centers around the spindle 22 by the weight of the scale mounting plate 28, and the scales 30 and 32. The magnitudes of this torque T of rotation and a torque T′ of rotation working on the second rotating member 40 by the elastic force of the coil spring 58 are set at an identical value, and also, the torques are in opposite directions. Accordingly, the scale mounting plate 28 cannot sharply rotate on the inclined drawing board 2 relative to the support base plate 18. The scale mounting plate 28 can be rotated 360 degrees by turning the handle 26. Therefore, the scales 30 and 32 can be set at a desired angle relative to the support base plate 18 of the head, and the scales 30 and 32 maintain a stable static condition relative to the head on the drawing board 2 even if the hands of the operator are off the handle 26. When the second rotating member 40 is rotated as the scales 30 and 32 rotate, the torque T′ of rotation of the coil spring 58 on the rotating member 40 changes in a sine curve as shown in FIG. 7. Even if the second rotating member 40 rotates more than 360 degrees, the rope 54 is not hooked with the rotating member 40 on account of the connection to the projection of member 50 from the rotating member 40 so that the scale mounting plate 28 can be rotated any number of times.

The operation of adjusting the magnitude of the torque T′ of rotation will be described in the following.

When the ring 44 is rotated, the ring 44 shifts along the feed screw 42, and the element 50 also shifts along the feed screw 42 by the foregoing shifting. One end 54*a* of the rope 54 shifts in a radial direction relative to the second rotating member 40 by the shifting of the element 50. The distance between the center of the rotating member 40 and the spring working point by the shifting of the one end 54*a* of the rope against the rotating member 40, namely, the radius of the torque of rotation generating element changes, and thus the torque T′ of rotation of the rotating member 40 changes. The value of a load W on the position of the center of gravity of the scale mounting plate 28 due to the weight of the scales 30 and 32 changes with a change of the angle of inclination of the drawing board 2. When the drawing board 2 is set at the vertical, the load W becomes a maximum, and when the drawing board 2 is set at the horizontal, the load W becomes zero. Accordingly, when the angle of inclination of the drawing board 2 is desired to be changed, the magnitude of the torque T′ of rotation produced on the second rotating member 40 by the tensile load of the coil spring 58 is made to coincide with the torque T of rotation produced on the first rotating member by the load W by rotatably adjusting the ring 44.

Figure 6:
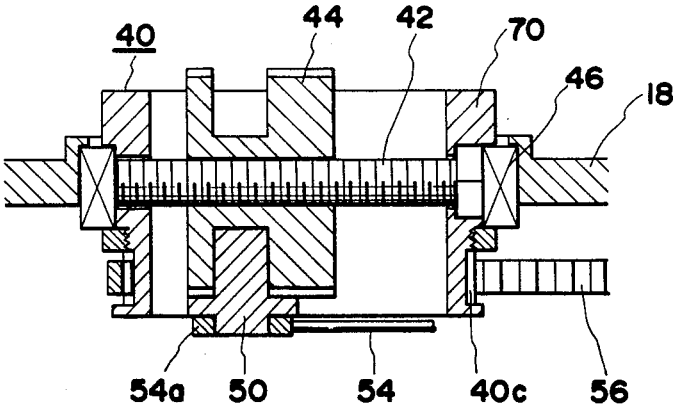
FIG. 6 is a cross section showing another embodiment of this invention.

The first rotating member 36 and the second rotating member 40 may be interlocked by the meshing of gears, and the connecting mechanism of the rotating members 36 and 40 is not particularly limited to a belt transmitting mechanism shown in the drawing. Also, the second rotating member 40 may be formed by a single cylinder 70 as shown in FIG. 6. Also, a rotation check mechanism may be provided on the ring 44 and the feed screw 42 may be rotatably arranged to shift toward the ring 44 by the rotation of the feed screw 42. In this case, the metal terminal 54*a* may be connected directly to the ring 44.

I claim:

1. A scale balancing device for balancing the weight of the scales of a universal parallel ruler, said device comprising a head structure having a rotating scale support rotatably mounted thereon on which said scales are carried, a rotating member rotatably mounted on said head structure offset from said rotating support, means rotatably interlocking said rotating member and said scale support, an eccentric member on said rotating member and having a portion projecting axially of said rotating member beyond the axial end surface of said rotating member, and a spring member having one end connected to said projecting portion and the other end connected to said head structure and tensioned for providing a torque on said rotating member in a direction which substantially cancels out the torque on said rotating member from the weight of the scales, whereby during rotation of the rotating member through 360 degrees, the one end of the spring member can continuously engage the projecting portion of said eccentric member and the spring member is not hooked by the rotating member.

2. A scale tensioning device as claimed in claim 1 in which said head structure has a supporting plate thereon, and said rotating member is a cylindrical member having the outer peripheral portion thereof rotatably journaled in said supporting plate.

3. A scale tensioning device as claimed in claim 2 in which said eccentric member is movable substantially diametrically of said cylindrical member and has a portion thereon projecting out of the end of said cylindrical member to which said spring is connected.

* * * * *